United States Patent [19]

Malless, Jr.

[11] 4,447,927

[45] May 15, 1984

[54] GUTTER CLEANING APPARATUS

[76] Inventor: George C. Malless, Jr., 9 Tynewick Ct., Silver Spring, Md. 20906

[21] Appl. No.: 414,513

[22] Filed: Sep. 2, 1982

[51] Int. Cl.[3] ..... E04D 13/06

[52] U.S. Cl. ..... 15/236 R; 15/145; 15/160

[58] Field of Search ..... 15/236 R, 145, 143 B, 15/144 R, 160, 105

[56] References Cited

U.S. PATENT DOCUMENTS 2,817,867 12/1957 Bugbird ..... 15/144 B X 3,626,542 12/1971 Despain et al. ..... 15/236 R 4,304,498 12/1981 George ..... 15/160 X 4,319,851 3/1982 Arthur ..... 134/167 C X

*Primary Examiner*—Chris K. Moore

*Attorney, Agent, or Firm*—Donald A. Kettlestrings

[57] ABSTRACT

Apparatus for cleaning leaves and other debris from overhead building gutters having a scoop-shaped body open at one end with a plurality of spike-like projections extending from the body. An inverted U-shaped attachment is connected to the scoop-shaped body, and at least one pole defining first and second free ends is provided for removable connection to the attachment.

19 Claims, 5 Drawing Figures

GUTTER CLEANING APPARATUS

This invention relates to apparatus for cleaning leaves and other debris from overhead building gutters, and more particularly to such apparatus having a scoop-shaped body open at one end and with a plurality of spike-like projections extending from the surfaces of the body.

Clogging of building gutters with leaves and other debris is a continuing problem. The improper drainage of rain water from the building roof which results from clogged gutters causes overflowing of the gutter in an undesirable matter.

A number of gutter cleaners have been devised to enable the cleaning of overhead building gutters from ground level. Although these devices have served the purpose, they have not proved entirely satisfactory under all conditions of service for the reason that they are relatively complex in construction and expensive to manufacture and maintain.

It is, therefore, an object of the present invention to provide an overhead gutter cleaner of relatively simple construction.

Another object is to provide such a cleaner which is easy to operate and to maintain.

A further object of the invention is the provision of such an overhead gutter cleaner which is inexpensive to operate and to maintain.

Still another object is to provide such an overhead gutter cleaner which is light in weight and which can be easily disassembled for compact storage.

Yet another object of the present invention is the provision of such an overhead gutter cleaner which enables the operator to clean overhead gutters while remaining at ground level.

Another object is to provide a gutter cleaner which retains leaves and other debris on and within the cleaner until the operator removes the cleaner from the gutter.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides apparatus for cleaning leaves and other debris from overhead building gutters wherein the apparatus comprises a scoop-shaped body defining first and second ends, a flat bottom surface and side portions, and defining an interior surface and an outer surface; a first plurality of spike-like projections extending from the interior surface; a second plurality of spike-like projections extending from the outer surface; an attachment member connected to the first end of the body, the attachment member defining a substantially inverted U-shaped configuration having a free end positioned adjacent to a side portion of the body; and at least a first pole defining first and second free ends, the first end of the pole and the free end of the attachment constructed to be removably connected to each other.

In accordance with the invention, a third plurality of spike-like projections extends from an outer portion of the bottom surface, and a predetermined number of the first plurality of spike-like projections extend from an inner portion of the bottom surface.

The second end of the scoop-shaped body is an open end, and additional poles are constructed to be removably connected to each other and to the first pole in predetermined end-to-end positions.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
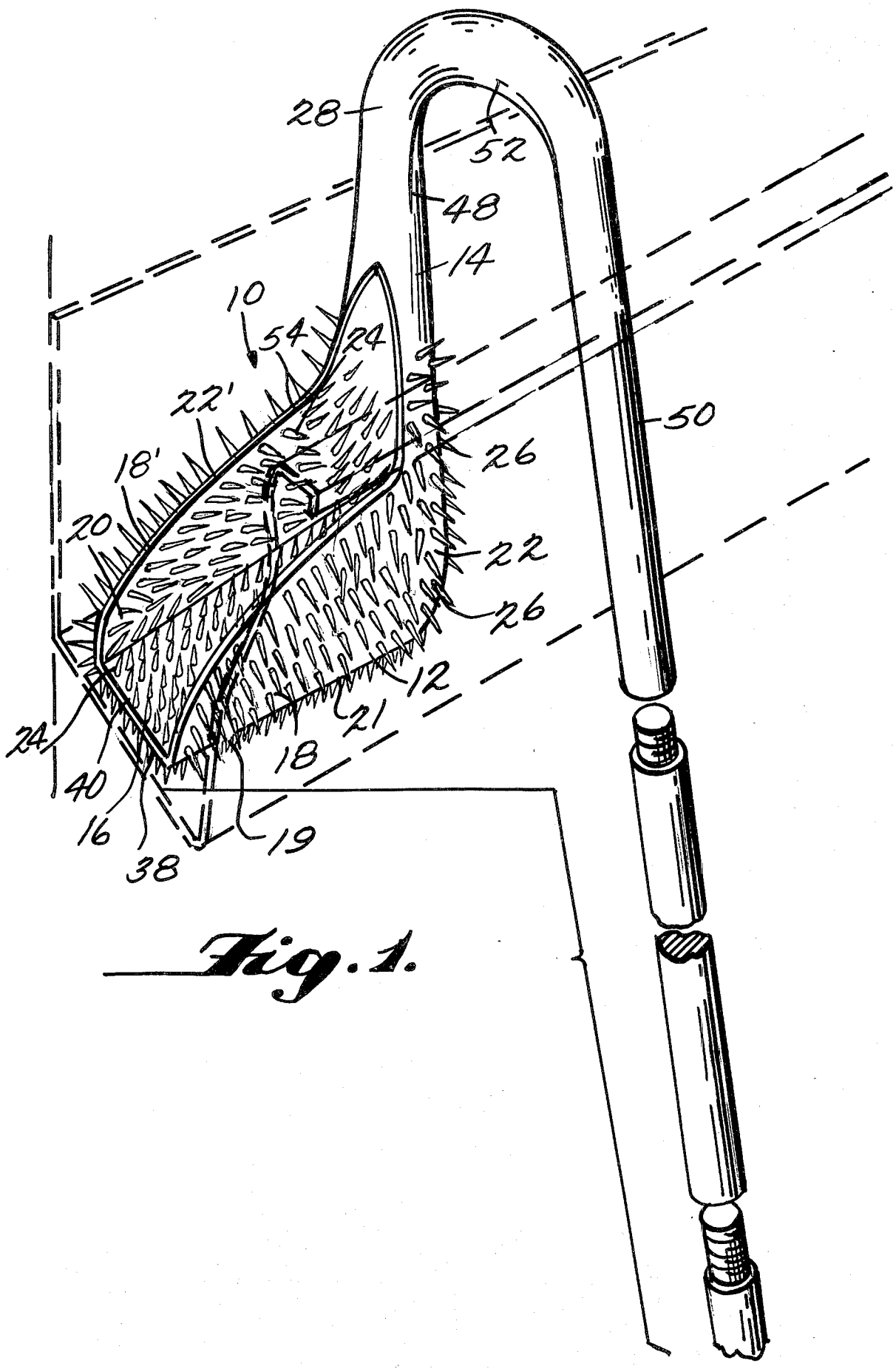
FIG. 1 is a fragmentary perspective view of the gutter cleaning apparatus.
Figure 2:
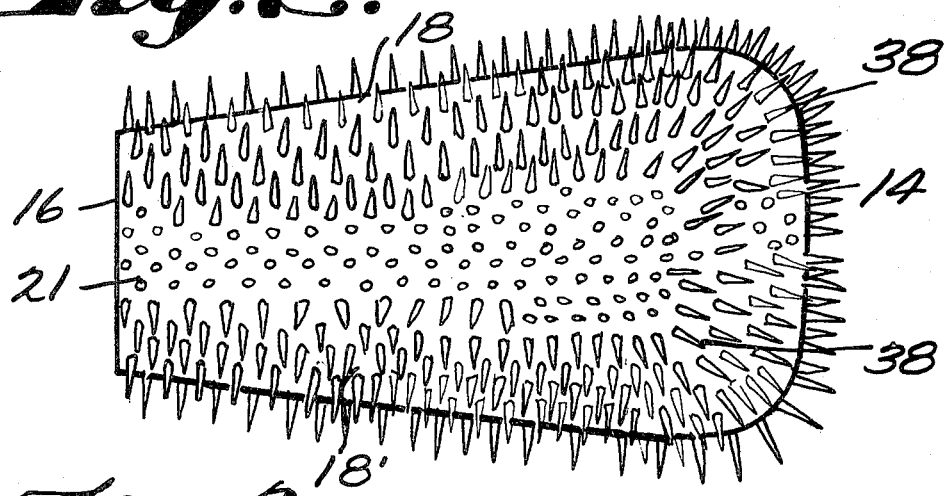
FIG. 2 is a bottom view of the scoop-shaped body.
Figure 3:
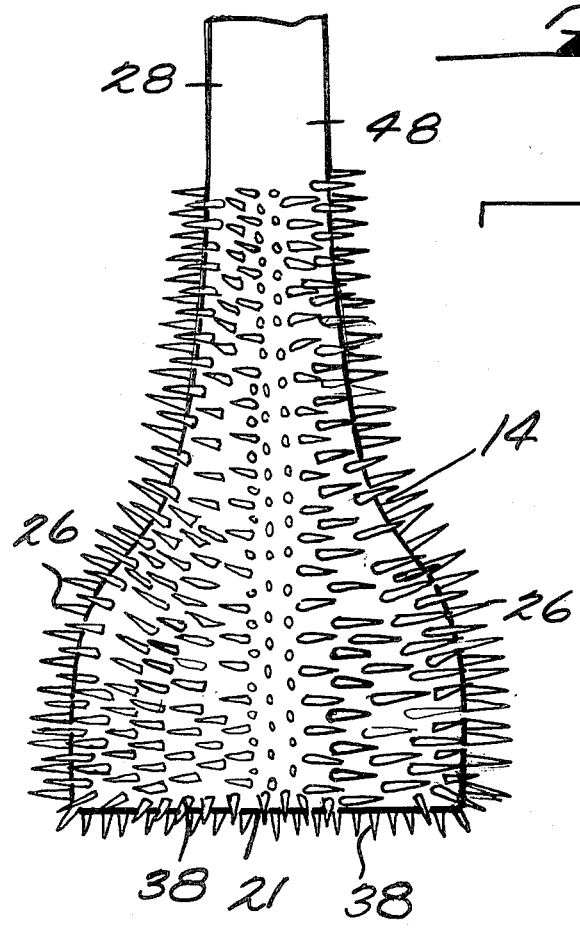
FIG. 3 is an end view of the scoop-shaped body and showing the first end of the body.
Figure 4:
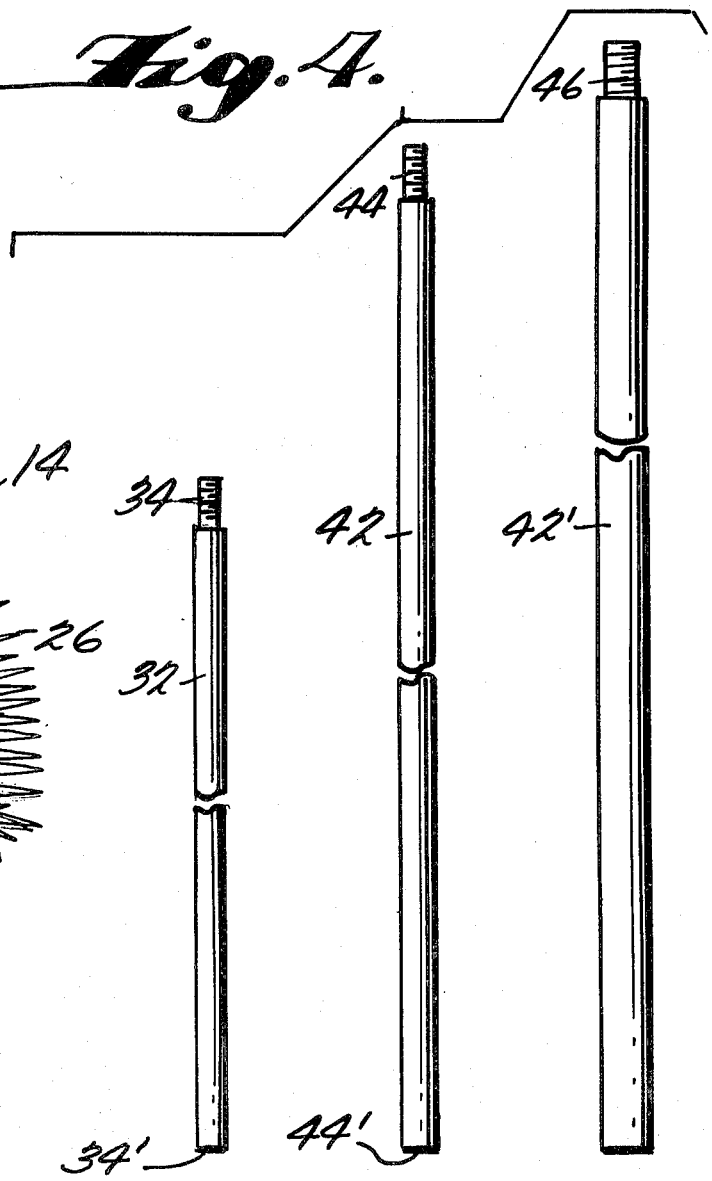
FIG. 4 is a fragmentary elevation view of the poles.

With reference now to the drawings, wherein like reference characters designate like or corresponding parts throughout the several views, there is shown in FIGS. 1–4 apparatus 10 in accordance with a preferred embodiment of this invention for cleaning leaves and other debris from overhead building gutters. Apparatus 10 includes a scoop-shaped body 12 defining a first end 14 and a second open end 16. Body 12 further defines side portions 18, 18' and a substantially flat bottom portion 19.

Side portions 18, 18' and bottom portion 19 define an interior surface 20. Side portions 18, 18' define outer surfaces 22, 22' and bottom portion 19 defines an outer surface 21. A first plurality of spike-like projections 24 extend from interior surface 20, and a second plurality of spike-like projections 26 extend from outer surfaces 22, 22'.

An attachment member 28 is connected to end 14 of body 12, and attachment member 28 defines a substantially inverted U-shaped configuration having a free end 30 positioned adjacent to side portion 18' of body 12.

At least a first pole 32, defining first and second free ends 34, 34', is provided, and end 34 of the pole and free end 30 of attachment 28 are constructed in a conventional manner to be removably connected to each other. For example, free end 30 of attachment member 28, could be hollowed and internally threaded to receive external threads on and adjacent to end 34 of pole 32.

In a preferred embodiment of the invention, a third plurality of spike-like projections 38 extend from an outer portion 21 of bottom portion 19, and a predetermined number of spike-like projections 24 extend from an inner portion 20 of bottom portion 19.

End 16 of scoop-shaped body 12 is open to admit leaves and other debris into the scoop as body 12 is moved lengthwise along the interior portion of the clogged gutter.

In order to adjust the height of the gutter cleaning apparatus to accomodate different heights of gutters and buildings, additional poles 42, 42' are constructed to be removably connected to each other and to first pole 32 in predetermined end-to-end positions. For example, end 34' of pole 32 may be hollow and interiorally threaded to receive an externally threaded end 44 of pole 42. Similarly, a hollow end 44' of pole 42 may be interiorally threaded to receive an externally threaded end 46 of pole 42'. It should be understood that various conventional types of construction may be used to enable the poles to be removably connected to each other and to enable pole 32 to be removably connected to attachment member 28.

In accordance with a preferred embodiment of the apparatus, the first plurality of spike-like projections 24 are preferably substantially one-quarter inch long, one-eighth inch in diameter at their bases and are spaced substantially one-eighth inch apart. The second plurality of spike-like projections 26 are preferably substantially one-half inch long, one-eighth inch in diameter at their bases and are spaced substantially one-eighth inch apart. The third plurality of spike-like projections 38 are preferably substantially one-quarter inch long, one-eighth inch in diameter at their bases and are spaced substantially one-eighth inch apart.

Attachment member 28 defines a first leg portion 48 which is connected to and extends upwardly from end 14 of body 12. Attachment member 28 further defines a second leg portion 50 which extends downwardly from a mid-portion 52, which mid-portion connects together leg portions 48 and 50. In accordance with a preferred embodiment of the invention, second leg 50 extends downwardly from mid-portion 52 at an angle of substantially five degrees with respect to first leg 48. This enables the operator of the apparatus to stand a sufficient distance away from the wall of the building when using the apparatus to clean the overhead gutters.

Mid-portion 52 of the attachment member 28 preferably extends substantially perpendicularly with respect to an imaginary plane (not shown) passing through ends 14, 16 of body 12 and through first leg 48. This enables the operator of the cleaning apparatus to stand to the side and below body 12 as the operator moves the scoop-shaped body along the gutter.

Body 12 is preferably made of polypropylene or other light weight plastic and is formed by walls 54 of substantially uniform thickness. A thickness of substantially three-sixteenth inch is suitable.

Attachment member 28 is preferably comprised of an acrylic or other strong light weight material to give the attachment member the sufficient stiffness and strength required for operation of the apparatus. Poles 32, 42, 42' are preferably made of polyvinylchloride or other plastic material.

Spike-like projections 24, 26 and 38 preferably extend substantially perpendicularly from their respective surfaces.

Figure 5:
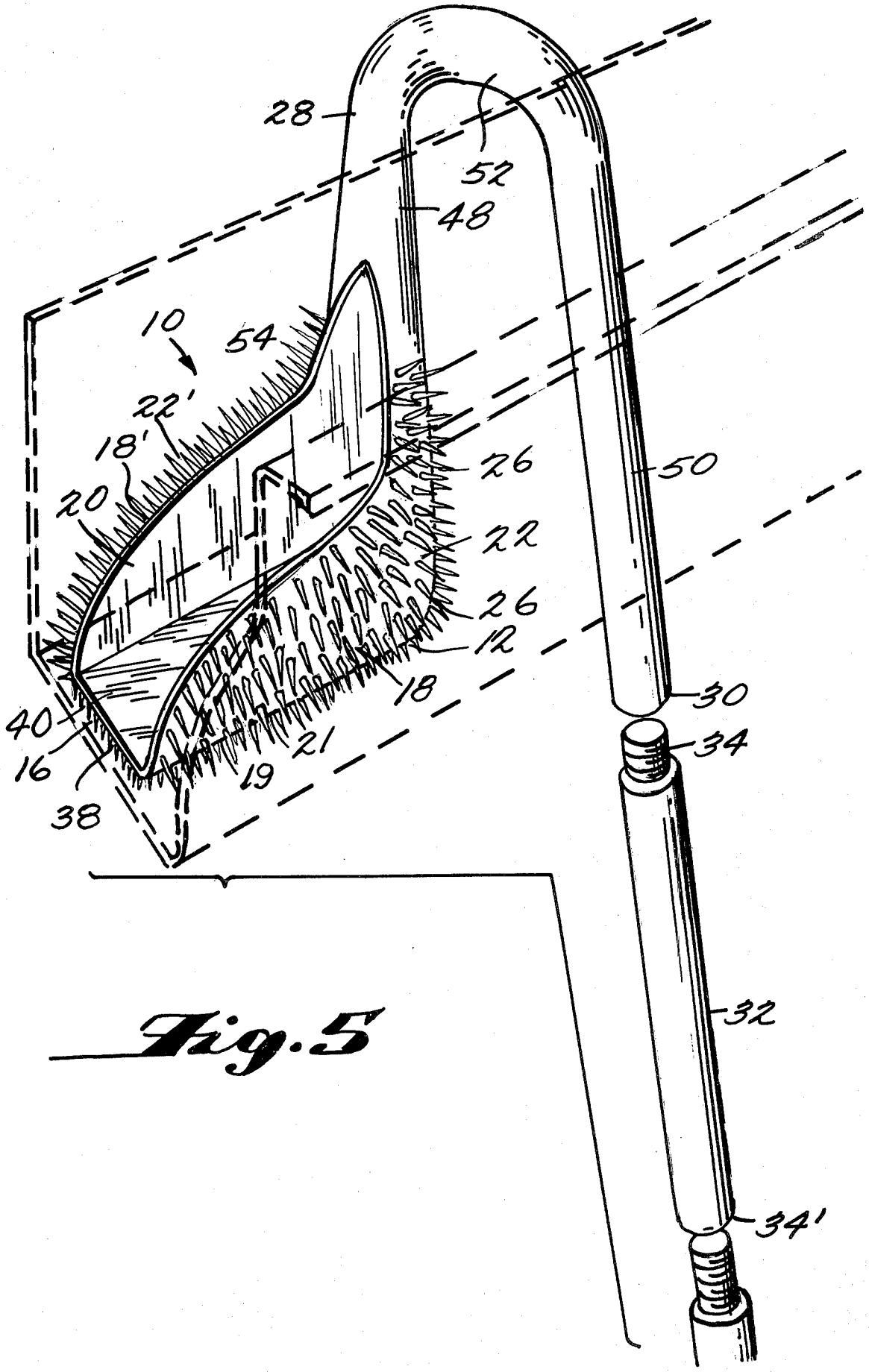
FIG. 5 is a fragmentary perspective view of another embodiment of the gutter cleaning apparatus.

Another embodiment of the gutter cleaning apparatus is shown in FIG. 5 wherein only spike-like projections 26 and 38 are provided on outer surfaces 22, 22' of portions 18, 18' and on outer surface 21 of bottom portion 19. No spike-like projections are provided on interior surface 20 of body 12. Otherwise, the construction and operation of this embodiment is the same as the embodiment of FIGS. 1–4.

In operation of gutter cleaning apparatus 10, poles 32, 42, and 42' are attached to member 20 and to each other as previously described. The operator then raises body 12 to a position overhead and within the building gutter. The operator then causes body 12 to move along the interior of the gutter in a direction toward open end 16 and so that leaves and other debris within the gutter are scooped up and into body 12 through the open end of the body. As the body moves along the interior of the gutter, the leaves and other debris are caught and held by spike-like projections 24, 26 and 38. In the case of the embodiment of FIG. 5, the leaves and other debris are scooped into the interior of body 12 and are caught and held by spike-like projections 26 and 38.

The operator can then remove body 12 from the interior of the gutter and can lower body 12 to ground level for the purpose of removing the leaves and other debris from body 12 and from the spike-like projections. The process is repeated, as necessary, until the gutter is cleared of leaves and other debris.

The gutter cleaning apparatus of this invention is of relatively simple construction, is light in weight and is inexpensive and easy to maintain and to store. The apparatus eliminates the need for the operator to climb up to gutter level in order to clean out the interior of overhead gutters.

The invention in its broader aspects is not limited to the specific details shown and described and departures may be made from such details without departing from the principles of the invention and without sacrificing its chief advantages.

What is claimed is:

1. Apparatus for cleaning leaves and other debris from overhead building gutters, said apparatus comprising:

a scoop-shaped body defining first and second ends, a bottom portion and side portions, and defining an interior surface and outer surfaces of said side and bottom portions;

a first plurality of spike-like projections extending from said interior surface;

a second plurality of spike-like projections extending from said outer surfaces of said side portions;

a third plurality of spike-like projections extending from said outer surface of said bottom portion;

an attachment member connected to said first end of said body, said attachment member defining a substantially inverted U-shaped configuration having a free end positioned adjacent to a side portion of said body; and at least a first pole defining first and second free ends, said first end of said pole and said free end of said attachment member constructed to be removably connected to each other.

2. Apparatus as in claim 1 wherein said second end of said scoop-shaped body is open.

3. Apparatus as in claim 2 further including additional poles constructed to be removably connected to each other and to said first pole in predetermined end-to-end positions.

4. Apparatus as in claim 3 wherein said first plurality of spike-like projections are substantially one-quarter inch long, one-eighth inch in diameter at their bases, and wherein said first plurality of spike-like projections are spaced substantially one-eighth inch apart.

5. Apparatus as in claim 4 wherein said second plurality of spike-like projections are substantially one-half inch long, one-eighth inch in diameter at their bases, and wherein said second plurality of spike-like projections are spaced substantially one-eighth inch apart.

6. Apparatus as in claim 5 wherein said third plurality of spike-like projections are substantially one-quarter inch long, one-eighth inch in diameter at their bases, and wherein said third plurality of spike-like projections are spaced substantially one-eighth inch apart.

7. Apparatus as in claim 6 wherein said body is comprised of polypropylene.

8. Apparatus as in claim 6 wherein said mid-portion of said attachment member extends substantially perpendicularly with respect to an imaginary plane passing through said first and second ends of said body and through said first leg.

9. Apparatus as in claim 7 wherein said attachment member is comprised of an acrylic material.

10. Apparatus as in claim 9 wherein said poles are comprised of polyvinylchloride.

11. Apparatus as in claim 1 wherein said attachment member defines first and second legs connected together by a mid-portion and wherein said first leg of said inverted U-shaped attachment member extends upwardly from said first end of said body, and the second leg of said inverted U-shaped attachment member extends downwardly from said mid-portion at an angle of substantially five degrees with respect to said first leg.

12. Apparatus as in claim 11 wherein said mid-portion of said attachment member extends substantially perpendicularly with respect to an imaginary plane passing through said first and second ends of said body and through said first leg.

13. Apparatus as in claim 1 wherein said first, second and third plurality of spike-like projections extend substantially perpendicularly from their respective surfaces.

14. Apparatus as in claim 13 wherein said scoop-shaped body is formed by walls of substantially uniform thickness.

15. Apparatus as in claim 14 wherein said bottom portion is substantially flat.

16. Apparatus for cleaning leaves and other debris from overhead building gutters, said apparatus comprising:

a scoop-shaped body defining first and second ends, a bottom portion and side portions, and defining an interior surface and outer surfaces of said side and bottom portions;

a plurality of spike-like projections extending from said outer surfaces of said side portions for catching and holding leaves and other debris as said body moves along the gutter;

a plurality of spike-like projections extending from said outer surface of said bottom portion for catching and holding leaves and other debris as said body moves along the gutter;

an attachment member connected to said first end of said body, said attachment member defining a substantially inverted U-shaped configuration having a free end positioned adjacent to a side portion of said body; and at least a first pole defining first and second free ends, said first end of said pole and said free end of said attachment member constructed to be removably connected to each other.

17. Apparatus as in claim 16 wherein said attachment member defines first and second legs connected together by a mid-portion and wherein said first leg of said inverted U-shaped attachment member extends upwardly from said first end of said body, and the second leg of said inverted U-shaped attachment member extends downwardly from said mid-portion at an angle of substantially five degrees with respect to said first leg.

18. Apparatus as in claim 16 wherein said spike-like projections extend substantially perpendicularly from their respective surfaces.

19. Apparatus as in claim 18 wherein said scoop-shaped body is formed by walls of substantially uniform thickness.

* * * * *